US008152941B2

(12) United States Patent
Sczerzenie et al.

(10) Patent No.: US 8,152,941 B2
(45) Date of Patent: Apr. 10, 2012

(54) NI-TI SEMI-FINISHED PRODUCTS AND RELATED METHODS

(75) Inventors: Francis E. Sczerzenie, Lake Pleasant, NY (US); Graeme William Paul, Rome, NY (US)

(73) Assignee: SAES Smart Materials, New Hartford, NY (US)

( * ) Notice: Subject to any disclaimer, the term of this patent is extended or adjusted under 35 U.S.C. 154(b) by 0 days.

(21) Appl. No.: 13/146,644

(22) PCT Filed: Oct. 28, 2010

(86) PCT No.: PCT/US2010/054579

§ 371 (c)(1), (2), (4) Date: Jul. 27, 2011

(87) PCT Pub. No.: WO2011/053737

PCT Pub. Date: May 5, 2011

(65) Prior Publication Data

US 2011/0277568 A1 Nov. 17, 2011

Related U.S. Application Data

(60) Provisional application No. 61/257,195, filed on Nov. 2, 2009, provisional application No. 61/308,236, filed on Feb. 25, 2010.

(51) Int. Cl.

| | |
|---|---|
| ***C22C 19/03*** | (2006.01) |
| ***C22C 30/00*** | (2006.01) |
| ***C22C 14/00*** | (2006.01) |
| ***G01N 33/20*** | (2006.01) |

(52) U.S. Cl. ..... 148/426; 420/580; 420/441; 420/417; 73/866; 428/547

(58) Field of Classification Search ..... 428/547; 148/426; 420/580, 441, 417; 73/866
See application file for complete search history.

(56) References Cited

U.S. PATENT DOCUMENTS

| | | | | |
|---|---|---|---|---|
| 2,906,008 | A * | 9/1959 | Boegehold et al. | 428/660 |
| 3,558,369 | A | 1/1971 | Wang et al. | |
| 3,660,082 | A | 5/1972 | Negishi et al. | |
| 4,037,324 | A | 7/1977 | Andreasen | |
| 4,337,900 | A | 7/1982 | Williams et al. | |
| 4,894,100 | A | 1/1990 | Yamauchi et al. | |
| 5,341,818 | A | 8/1994 | Abrams et al. | |
| 5,411,476 | A | 5/1995 | Abrams et al. | |
| 5,637,089 | A | 6/1997 | Abrams et al. | |
| 5,695,111 | A | 12/1997 | Nanis et al. | |
| 6,165,292 | A | 12/2000 | Abrams et al. | |
| 6,280,539 | B1 | 8/2001 | Abrams et al. | |
| 6,379,369 | B1 | 4/2002 | Abrams et al. | |
| 6,461,453 | B1 | 10/2002 | Abrams et al. | |
| 6,592,570 | B2 | 7/2003 | Abrams et al. | |
| 6,602,228 | B2 | 8/2003 | Nanis et al. | |
| 6,620,172 | B1 | 9/2003 | Dretler et al. | |
| 6,638,372 | B1 | 10/2003 | Abrams et al. | |
| 6,682,608 | B2 | 1/2004 | Abrams et al. | |
| 7,244,319 | B2 | 7/2007 | Abrams et al. | |
| 7,258,753 | B2 | 8/2007 | Abrams et al. | |
| 2002/0046785 | A1 | 4/2002 | Abrams et al. | |
| 2002/0087099 | A1 | 7/2002 | Nanis et al. | |
| 2002/0112788 | A1 | 8/2002 | Tanaka et al. | |
| 2002/0121316 | A1 | 9/2002 | Abrams et al. | |
| 2003/0069492 | A1 | 4/2003 | Abrams et al. | |
| 2003/0127158 | A1 | 7/2003 | Abrams et al. | |
| 2004/0084115 | A1 | 5/2004 | Abrams et al. | |
| 2005/0027214 | A1 * | 2/2005 | Murayama et al. | 600/585 |
| 2006/0037672 | A1 | 2/2006 | Love et al. | |
| 2007/0249965 | A1 | 10/2007 | Abrams et al. | |
| 2008/0053577 | A1 | 3/2008 | Syed et al. | |

FOREIGN PATENT DOCUMENTS

| | | |
|---|---|---|
| EP | 0465836 | 6/1991 |
| EP | 1493393 | 6/2000 |
| JP | 59-028548 | 2/1984 |
| JP | 60026648 | 2/1985 |
| JP | 63235444 | 9/1988 |
| WO | 02/063375 | 8/2002 |
| WO | 2008/030517 | 3/2008 |

OTHER PUBLICATIONS

ASM International, Materials Park, Ohio, Properties and Selection: Irons, Steels, and High-Performance Alloys, vol. 1, "Wrought Stainless Steels", pp. 841-846.*

Buehler, W. J. & Wiley, R. C., Ti Ni-Ductile intermetallic compound, *Trans Quarterly ASM*, vol. 55, 269-276 (1962).

Buehler, W. J. et al., Effect of Low-Temperature Phase Changes on the Mechanical Properties of Alloys near Composition TiNi, *J. Applied Physics*, vol. 34, 1475-1477 (May 1963).

Naval Ordnance Lab., Effects of Alloying upon Certain Properties of 55.1 Nitinol, *NOLTR* 64-235 (1965).

Wang, F. E. et al, Crystal Structure and a Unique 'Martensitic' Transition of TiNi, *J. Applied Physics*, vol. 36, No. 10, 3232-3239 (Oct. 1965).

Andreason G. F. & Hilleman, T. B., An Evaluation of 55 cobalt substituted Nitinol wire for use in orthodontics, *JADA*, vol. 82, 1373-1375 (Jun. 1971).

(Continued)

*Primary Examiner* — Jessee R. Roe

(74) *Attorney, Agent, or Firm* — Steinfl & Bruno LLP

(57) ABSTRACT

Semi-finished products for the production of devices containing thermoelastic materials with improved reliability and reproducibility are described. The semi-finished products are based on an alloy of Ni—Ti plus elements X and/or Y. The nickel amount is comprised between 40 and 52 atom %, X is comprised between 0.1 and 1 atom %, Y is comprised between 1 and 10 atom % and the balance is titanium. The one or more additional elements X are chosen from Al, Ta, Hf, Si, Ca, Ce, La, Re, Nb, V, W, Y, Zr, Mo, and B. The one or more additional elements Y are chosen from Al, Ag, Au, Co, Cr, Fe, Mn, Mo, Nb, Pd, Pt, Ta and W.

13 Claims, No Drawings

OTHER PUBLICATIONS

Andreason, G. F. & Barrett, R. D., An evaluation of cobalt-substituted nitinol wire in orthodontics, *American Journal of Orthodontics*, vol. 63, No. 5, 462-470 (1973).

Schwenk, W. & Huber, J., Nitinol as a Fastener Material, *SAMPE Quarterly*, 17-21 (Jan. 1974).

Eckelmeyer, K. H., *Scripta Metallurgica*, vol. 10, 667-672 (1976).

Miura, F. et al., The super-elastic property of the Japanese NiTi alloy wire for use in orthodontics, *American Journal of Orthodontics and Dentofacial Orthopedics*, vol. 90, No. 1, 1-10 (1986).

Wayman, C. M., Shape Memory Alloys, *MRS Bulletin*, 49-56 (Apr. 1993).

Hosoda, H. et al., Martensitic transformation temperatures and mechanical properties of ternary NiTi alloys with offstoichiometric compositions, *Intermetallics*, vol. 6, 291-301 (1998).

Ma, J. L. and Wu, K. H., Effects of tantalum addition on transformation behaviour of $(Ni_{51}Ti_{49})_{1-x}Ta_x$ and $Ni_{50}Ti_{50-y}Ta_y$ shape memory alloys, *Materials Science and Technology*, vol. 16, 716-719 (Jun. 2000).

Nishida, M. et al., Precipitation Processes in Near-Equiatomic NiTi Shape Memory Alloys, *Metallurgical Transactions A*, vol. 17A, 1505-1515 (Sep. 1986).

Civjan, S. et al., Potential Applications of Certain Nickel-Titanium (Nitinol) Alloys, *J. Dent. Res.*, vol. 54, No. 1, 89-96 (1975).

Kishi, Y. et al., Relation between Tensile Deformation Behavior and Microstructure in a Ti-Ni-Co Shape Memory Alloy, *Materials Transactions*, vol. 43, No. 5, 834-839 (2002).

Miura, F. et al., The super-elastic Japanese NiTi alloy wire for use in orthodontics, *American Journal of Orthodontics and Dentofacial Orthopedics*, vol. 94, No. 2, 89-96 (1988).

PCT International Search Report for PCT/US2010/054579 filed on Oct. 28, 2010 in the name of Saes Smart Materials.

PCT Written Opinion for PCT/US2010/054579 filed on Oct. 28, 2010 in the name of Saes Smart Materials.

* cited by examiner

NI-TI SEMI-FINISHED PRODUCTS AND RELATED METHODS

CROSS REFERENCE TO RELATED APPLICATIONS

The present application is the U.S. national stage of International Application PCT/US2010/054579 filed on Oct. 28, 2010, which, in turn, claims priority to U.S. Provisional Application No. 61/257,195, filed on Nov. 2, 2009, and U.S. Provisional Application No. 61/308,236, filed on Feb. 25, 2010, all of which are incorporated herein by reference in their entirety.

FIELD

The present disclosure relates to Ni—Ti (nickel-titanium) based alloys. In particular, it relates to improved Ni—Ti semi-finished products and related methods. More particularly, the nickel content is comprised between 40 and 52 atom %.

BACKGROUND

Ni—Ti alloys with a nickel content comprised between 50 and 52 atom % pertain to the category of thermoelastic materials (also known in the field as Nitinol, Shape Memory Alloys, "smart" materials, etc), and according to the finishing process they undergo (e.g., training, shape setting, education, etc), they may exhibit a shape memory effect or a superelastic behavior. Details of suitable processes and characteristics of these alloys are widely known in the art and may be found in C. M. Wayman, "Shape Memory Alloys" MRS Bulletin, April 1993, 49-56, M. Nishida et al., "Precipitation Processes in Near-Equiatimic TiNi Shape Memory Alloys", Metallurgical Transactions A, Vol 17A, September, 1986, 1505-1515, and H. Hosoda et al., "Martensitic transformation temperatures and mechanical properties of ternary NiTi alloys with offstoichiometric compositions", Intermetallics, 6(1998), 291-301, all of which are herein incorporated by reference in their entirety.

These alloys are employed in a variety of applications. By way of example and not of limitation, in industrial applications, shape memory wires are used in actuators as a replacement for small motors. Further applications for such thermoelastic materials include the medical field, where they are used for stents, guidewires, orthopedic devices, surgical tools, orthodontic devices, eyeglass frames, thermal and electrical actuators, etc.

Independently from the final shape of the Ni—Ti thermoelastic device, that can for example be wire or tube or sheet or bar based, the manufacturing process includes a cutting phase from a longer metallic piece, obtained from a semi-finished product resulting from an alloy melting process. The most common forms for the semi-finished products are long tubes, wires, rods, bars, sheets.

The behavior of these Ni—Ti alloys is strongly dependent on their composition. The presence of one or more additional elements may result in new properties and/or significantly alter the characteristic and behavior of the alloy. The importance of the purity of the Ni—Ti alloy is addressed in US Pub. App. US2006/0037672, incorporated herein by reference in its entirety.

U.S. Pat. No. 4,337,900 discloses use of Ni—Ti alloys with an additional amount of copper ranging from 1.5 to 9 atom % to improve workability and machinability.

Another ternary modification of Ni—Ti alloys with reference to superleastic alloys is described in PCT patent publication WO2002063375, where a wide compositional range is described. In particular, the substituent, chosen from Cu, Fe, Nb, V, Mo, Co, Ta, Cr and Mn, may vary between 1% and 25 atom %.

European patent EP 0465836 discloses addition of carbon and optional small metal amounts. The carbon amount is comprised between 0.25 and 5 atom %. The optionally added metals are comprised between 0.25 and 2 atom % and are chosen from V, Cr, Fe, Nb, Ta, W, and Al.

Improved corrosion and wear resistant Ni—Ti alloys are disclosed in U.S. Pat. No. 3,660,082, where such effect is achieved substituting nickel with one or more metals chosen from Fe, Mo, Co, and Cr, while Ti is substituted with Zr. The nickel substitution range is 1-50 atom % and the titanium substitution range is 0-10 atom %.

The addition of a rare earth element in order to get a radiopaque alloy is disclosed in PCT publication WO2008/030517 where additions of La, Pr, Nd, Pm, Sm, Eu, Gd, Tb, Dy, Ho, Er, Tm, Yb, Lu, Ac, Tn, Pa and U may be made in an atom percentage range between 0.1 and 15.

Japanese patent application JP 59028548 discloses Ni—Ti alloys, where nickel or titanium atoms are substituted with no more than 1 atom % of one or more elements chosen from V, Cr, Mn, Fe, Co, Cu, Zr, Nb, Mo, Ta and noble metals.

Japanese patent application JP 63235444 describes Ni—Ti—Al alloys having good phase transformation at low temperature, where Al is up to 2 atom %, and where up to 1 atom % of one or more elements chosen from V, Cr, Mn, Co, Zr, Nb, Mo, Ru, Ta and W may be present.

JP 60026648 describes an annealing and cold rolling finishing process for Ni—Ti alloys containing up to 3 atom % of one or more elements chosen from V, Cr, Mn, Fe, Co, Cu, Zr, Nb, Mo, Pd, Ag, Ru, Ta and W.

All these references teach the addition or alternatively the substitution (decreasing the amount of titanium or nickel in proportion to the amount of the additional element) of one or more element to Ni—Ti alloys to modify their properties.

SUMMARY

None of the above references teaches another important aspect, the reproducibility of the final or finished product. Reproducibility is particularly critical, since a plurality of devices or products are made from the same semi-finished product. By way of example, a very large number of cardiac stents (even millions) can be made from a single semi-finished product.

According to a first aspect of the present disclosure, a semi-finished product is provided, comprising: a nickel-titanium alloy and an amount X of one or more additional elements, wherein: nickel amount is comprised between 40 and 52 atom %, the amount X is comprised between 0.1 and 1 atom %, the balance being titanium. The one or more additional elements are selected from Al, B, Ca, Ce, Hf, La, Mo, Nb, Re, Si, Ta, V, W, Y and Zr. The amount X and the element or elements in the X amount are selected to result in variation of the amount X over different points of the semi-finished product being less than a set percentage.

According to a further aspect of the present disclosure, a method of using a semi-finished product is provided, to determine the variation of the amount X over different points of the semi-finished product, comprising: sampling points along a length of the semi-finished product at a set distance between points; and for each point, measuring the amount X.

According to another aspect of the present disclosure, a method to manufacture a semi-finished product is provided, comprising: providing a nickel-titanium alloy; and adding an amount X of one or more of Al, B, Ca, Ce, Hf, La, Mo, Nb, Re, Si, Ta, V, W, Y and Zr, wherein nickel is comprised between 40 and 52 atom %, X is comprised between 0.1 and 1 atom %, the balance being titanium, wherein X is variable over the semi-finished product, variation of X over the semi-finished product being less than 20% of the contained amount of X.

According to a further aspect of the present disclosure, a semi-finished product is provided, comprising: a nickel-titanium alloy and an amount Y of one or more additional elements, wherein: nickel amount is comprised between 40 and 52 atom %, the amount Y is comprised between 1 and 10 atom %, the balance being titanium; the one or more additional elements are selected from Al, Ag, Au, Co, Cr, Fe, Mn, Mo, Nb, Pd, Pt, Ta and W; and the amount Y and the one or more additional elements are selected to result in variation of the amount Y over different points of the semi-finished product being less than a set percentage.

According to yet another aspect of the disclosure, a method to manufacture a semi-finished product is provided, comprising: providing a nickel-titanium alloy; and adding an amount Y of one or more of Al, Ag, Au, Co, Cr, Fe, Mn, Mo, Nb, Pd, Pt, Ta and W, wherein nickel is comprised between 40 and 52 atom %, Y is comprised between 1 and 10 atom %, the balance being titanium, wherein Y is variable over the semi-finished product, variation of Y over the semi-finished product being less than 20%.

According to still another aspect of the disclosure, a composition of matter is provided, comprising a nickel-titanium alloy and one or more elements X and Y wherein X is 0.1 to 1 atom % of one or more elements chosen from Al, B, Ca, Ce, Hf, La, Mo, Nb, Re, Si, Ta, V, W, Y and Zr and wherein Y is 1 to 10 atom % of one or more elements chosen from Al, Ag, Au, Co, Cr, Fe, Mn, Mo, Nb, Pd, Pt, Ta and W.

Additional aspects of the disclosure are shown in the description and claims of the present application.

DESCRIPTION

The applicants have found that in order to both improve the characteristics of a single final Ni—Ti thermoelastic material element (also known in the field as Nitinol, Shape Memory Alloy, "smart" material, etc) and the reliability and reproducibility of a plurality of thermoelastic material elements without changing most of the properties of the material (such as transformation temperature and its range, mechanical properties, corrosion resistance and biocompatibility), a semi-finished product with improved characteristics with respect to what is disclosed in the prior art has to be provided. A semi-finished product is a product whose shape has not completely been set and whose surface conditions still have to be determined. Shape and surface conditions will be modified and determined depending on the kind of finished product to be obtained. Usually, a semi-finished product is longer or much longer than the finished product to be obtained.

The properties of Ni—Ti alloys are greatly influenced by the addition of even small amounts of one or more additional elements, in ways that are often not predictable. Several embodiments of the present disclosure are directed to a selection of elements that modify the inclusion content of the semi finished product by reducing the amount and/or the size of the inclusions as described below. Further embodiments of the present disclosure are directed to a selection of elements that provides a semi-finished product with higher stiffness and/or plateau stress than binary NiTi alloys. Throughout the present disclosure, stiffness will be defined as resistance to elastic deformation, while plateau stress will be defined as the stress at which the load is constant during a thermoelastic mechanical transformation. In particular, lower plateau stress (LPS) will be defined as the stress at 2.5% strain during unloading of the sample after loading to 6% strain, and upper plateau stress (UPS) will be defined as the stress at 3% strain during loading of the sample, as also defined in FIG. 1 (not shown) of the ASTM F2516 Standard Test Method for Tension Testing of Nickel-Titanium Superelastic Materials.

To the best of the Applicants' knowledge, there is no literature (e.g., in the form of tabulated data) available to describe the affinity of added elements towards oxygen and carbon in presence of a Ni—Ti matrix, particularly at high temperatures. Additionally, no kinetic data are currently available to predict if and to which extent the added elements will react with carbon and oxygen in the presence of NiTi at high temperatures. Therefore, it is currently not possible to predict what effect the added elements have on the size and number of carbides and/or the size/number of the intermetallic oxide inclusions.

Reaction of Ni—Ti alloys with carbon to form TiC (carbides) is described in M. Nishida, C. M. Wayman and T. Honma, "Precipitation Processes in Near-Equiatomic NiTi Shape Memory Alloys", Metallurgical Transactions, A, Volume 17A, September, 1986, pp 1505-1515 incorporated herein by reference in its entirety, where formation of Ti2NiOn (intermetallic oxides) is also observed, where n in an integer number equal to or greater than 1.

Applicants have observed the formation of both types of inclusions in vacuum melted alloys. The type and sequence of inclusions formed depends on several factors including the purity of raw materials and the melting process or processes used. In alloy melted by VAR (vacuum arc re-melting) or by ISM (induction skull melting) the first inclusions formed are both carbides and intermetallic oxides. If the carbon content is low, the number and size of the carbides is low. If the oxygen content is in the normal range a significant number of intermetallic oxides will be formed. If oxygen is high (1000 ppm) a large number of very large intermetallic oxides will be formed.

Most NiTi thermoelastic alloys are made by a combination of vacuum melting processes. The dominant commercial process at this time is VIM (vacuum induction melting) in a graphite crucible followed by one or more cycles of VAR. Applicants have observed carbides and intermetallic oxides in cast alloy after thermal exposure and in several types of semi-finished products. The amount and size of these particles depend on the trace element chemistry of the alloy and its thermal history.

Applicants have observed that the primary and only indigenous inclusions found in as-cast VIM alloys are carbides (TiC). Similarly, applicants have observed that the primary and only indigenous inclusions found in VIM-VAR alloy are also carbides (TiC). Applicants have further observed that intermetallic oxides are formed in cast VIM and cast VIM-VAR NiTi alloys by the reaction of carbides with the NiTi alloy matrix which includes trace amounts of oxygen, nitrogen and the less noble elements including Al and Si such that the intermetallic oxide is better annotated as Ti(X)2Ni(Y)O(N,C)n.

According to an embodiment of the present disclosure, a semi-finished product is provided, based on an alloy of Ni—Ti plus a small amount X of one or more additional elements, wherein the nickel amount is comprised between 40 and 52 atom %, the small amount X of one or more additional elements is comprised between 0.1 and 1 atom % and the balance titanium. The one or more additional elements are chosen from Al, B, Ca, Ce, Hf, La, Mo, Nb, Re, Si, Ta, V, W, Y and Zr. At melting and processing temperatures for forming the semi-finished products, such elements have an affinity for carbon (in order to form carbides) and/or oxygen (in order to form oxides) greater than titanium and nickel.

The one or more additional elements and the amount X are chosen so that the variation of the content of the one or more additional elements over different points of the semi-finished product is contained within a set value. Such set value can be, for example, less than about 20%.

According to a further embodiment, X is chosen from Al, Ca, Hf, La, Ta, and Y.

According to another embodiment of the present disclosure, a method to manufacture the Ni—Ti—X alloy is disclosed, the method comprising adding X to a Ni—Ti alloy base composition.

The applicants have found that in some embodiments of the present disclosure, for some metals such as Al, B, Ca, La, Re, Si, W, Y, Zr, the maximum content for each element in order to secure reproducibility and contain variation is up to 0.5 atom %, notwithstanding the condition on the upper cumulative value for X at 1 atom %. On the other hand, in some embodiments, the remaining metals Ce, Hf, Mo, Nb, Ta, V can be present in higher concentrations, up to 1 atom %. Also in this latter case, the upper limit for the cumulative presence of these elements is 1 atom %.

The lower limit of X at 0.1 atom % is the minimum amount where it is possible to achieve a technical effect in term of minimizing the presence and/or size of the inclusions while maintaining similar material properties as compared to binary NiTi alloys. In particular, Applicants have noted a decrease of inclusion content in the semi-finished product starting at X=0.1 atom %. Uniformity per unit of length of the semi-finished Ni—Ti—X product provides a stable and reproducible behavior of the final device using the thermoelastic material product derived from the semi-finished Ni—Ti—X product. It should also be noted that uniformity of a semi-finished product is especially desirable, also in view of the typical extension of a semi-finished product, which is much longer than the finished products fabricated therefrom.

As a particular result, applicants have determined that a good stability is ensured if the percentage of the additional elements present in the Ni—Ti alloy does not vary more than about 20% over the length of the semi-finished product.

In accordance with embodiments of the present disclosure, there are two ways in which variation measurement can be made, chosen according to the value of X. When X is higher than 0.2 atom % it is sufficient to take three values, at the extremities and at the middle of the semi-finished product and verify that the maximum spread/variation in the composition of the additional metals present in the Ni—Ti—X composition is less or equal than 20%. On the other hand, when X is equal or less than 0.2 atom %, measurements can be taken from samples every few meters along the length of the semi-finished product, and verify that the spread of all these measurements falls within about 20%. For example, in making small diameter bars in the range of 12 to 33 mm diameter, the semi-finished product is tested at 50.8 mm round cornered square (RCS). At 50.8 mm RCS, there are 16 bars numbered in sequence from the bottom of the ingot to the top of the ingot. Test samples may be taken from the bottom of the first bar and the top of each bar to map out chemistry, microstructure and properties throughout the ingot product.

Possible shapes for the Ni—Ti—X semi finished product can be selected between, but not limited to, wires, tubes, rods and sheets, and ingots. Finished products can then be obtained from the semi finished products, e.g. by cutting.

The above mentioned uniformity of composition per unit length may be achieved using tailored melting and processing for the production of the semi-finished Ni—Ti—X product. Such processes can, for example, be a first melting by, but not limited to, vacuum induction melting (VIM) to produce castings of Ni—Ti—X alloys. Other primary melting processes may be employed including, but not limited to, induction skull melting, plasma melting, electron beam melting and vacuum arc melting. The castings are then employed as meltable electrodes in a VAR (Vacuum Arc Re-Melting) fusion process.

According to further embodiments of the present disclosure, a semi-finished product based on an superelastic material with improved stiffness, plateau stress and bending modulus with respect to binary Nitinol is provided. The semi-finished product is based on an alloy of Ni—Ti plus a small amount Y of one or more additional elements, wherein the nickel amount is comprised between 40 and 52 atom % and the small amount Y of one or more additional elements is comprised between 1 and 10 atom %, where Y can be a combination of one or more elements $Y_1$, $Y_2$, $Y_3$, etc. and the balance titanium.

The one or more elements forming the amount Y are chosen from Al, Ag, Au, Co, Cr, Fe, Mn, Mo, Nb, Pd, Pt, Ta and W. These can vary from 1 to 10 atom % depending on the element. In particular Co, Cr, Fe and Ta can vary from 1 to 4 atom %. Limitation to 4 atom % allows to maintain workability and superlasticity at ambient and body temperature.

Moreover, it has been noted that a particular embodiment of Y is where is Y is chosen from Ag, Au, Mo, Pd, Pt, W, each of which is limited to 1 atom % to maintain workability and superlasticity at ambient and body temperature.

Some elements are common to the selection for X and Y. These elements are Al, Mo, Nb, Ta, W. Applicant's current understanding is that some strong carbide and/or oxide formers (such as Al, Mo, Ta, W) stabilize inclusions when used at a lower alloy content less than 1 atom %. In particular, at low amounts these elements will partition to carbides and/or intermetallic oxides resulting in a finer distribution of inclusions. At intermediate amounts they will substitute for Ti and/or Ni in the thermoelastic matrix alloy and increase stiffness and mechanical properties. An example is the NiTi-14.5 w/o Nb alloy.

By way of example and not of limitation, Applicants have made and tested alloys centered around 1.20 atom % Co (49.55 a/o Ni, 1.20 a/o Co, Balance Ti), centered around 1.53 atom % Fe (49.22 a/o Ni, 1.53 a/o Fe, Balance Ti) and centered around 1.28 atom % Cr (49.47 a/o Ni, 1.28 a/o Cr, Balance Ti). These alloys are superelastic at ambient temperature and have workability comparable to binary NiTi. Reference can be made to the tables below, where it is shown that the NiTiCo and NiTiCr alloys have higher modulus in 3 point bend and higher plateau stress in tensile.

TABLE 1

(3-Point Bend Data)

| Heat Number | Aim As (° C.) | Alloy | Modulus (ksi) | Loading Plateau (lb/f) | Unloading Plateau (lb/f) |
|---|---|---|---|---|---|
| CX-1723 | −80 | NiTiCo | 85 | 6.50 | 4.50 |
| CX-2339 | −80 | NiTiCr | 100 | 6.75 | 5.00 |
| C5-8921 | −60 | NiTi | 70 | 5.50 | 3.50 |
| C5-9511 | −12 | NiTi | 60 | 4.50 | 3.00 |

TABLE 2

(Tensile Data)

| Heat Number | Alloy | UTS (ksi) | Elongation (%) | UPS (ksi) | LPS (ksi) | Residual Strain (%) |
|---|---|---|---|---|---|---|
| CX-1723 | NiTiCo | 220 | 20 | 110 | 80 | 0.5 |
| CX-2339 | NiTiCr | 230 | 13 | 120 | 100 | 0.1 |
| C5-8921 | NiTi | 240 | 13 | 90 | 65 | 0.1 |
| C5-9511 | NiTi | 220 | 20 | 75 | 40 | 0.5 |

In particular, as shown in Tables 1 and 2, at comparable $A_s$ (target austenite start temperature, see also ASTM Standard F2005) the addition of a ternary Co or Cr alloy improves the stiffness of the material. The NiTiCo alloy has a 21% higher modulus, 18% higher loading plateau, 28% higher unloading plateau, 22% higher UPS (upper plateau stress) and 23% higher LPS (lower plateau stress) when compared to a binary alloy with a similar $A_s$ temperature. A NiTiCr alloy has a 43% higher modulus, 23% higher loading plateau and 43% higher unloading plateau, 33% higher UPS and 54% higher LPS when compared to a binary alloy with a similar $A_s$ temperature. Moreover, the NiTiCr alloy has a 18% higher modulus, 4% higher loading plateau, 11% higher unloading plateau, 9% higher UPS and 25% higher LPS when compared to the NiTiCo alloy. Moreover, lowering the $A_s$ temperature of the binary alloy (from −15 to −60° C.) improves the modulus by 17%, the loading plateau by 22% and the unloading plateau by 17%. This shows that the modulus increase and the plateau stress increases achieved in the ternary alloys are not solely due to transformation temperature reduction but involve alloying effects.

Further embodiments of the present disclosure are directed to quaternary or quintenary alloys, such as the quintenary alloy 49.46 a/o Ni, 1.21 a/o Co, 0.075 a/o Ta, 0.015 a/o Hf, Balance Ti or the quintenary alloy 49.47 a/o Ni, 1.21 a/o Co, 0.075 a/o Ta, 0.015 a/o La, Balance Ti. In other words, in the first case the one or more elements X are Ta centered around 0.075 atom % and Hf centered around 0.015 atom % and the one or more elements Y are Co centered around 1.21 atom %, while in the second case the one or more elements X are Ta centered around 0.075 atom % and La centered around 0.015 atom % and the one or more elements Y are Co centered around 1.21 atom %.

Also in this case, applicants have noted that selection of the amount Y in accordance with the above paragraph resulted in variation of the amount Y over different points of the semi-finished product being less than a set percentage.

In accordance with several embodiments of the present disclosure, the amount of carbon can be up to 0.22 atom % and the amount of oxygen can be up to 0.17 atom %.

The examples set forth above are provided to give those of ordinary skill in the art a complete disclosure and description of how to make and use the embodiments of the improved Ni—Ti semi-finished products and related methods of the disclosure, and are not intended to limit the scope of what the applicants regard as their disclosure. Modifications of the above-described modes for carrying out the disclosure may be used by persons of skill in the art, and are intended to be within the scope of the following claims. All patents and publications mentioned in the specification may be indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular devices, products, methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. A semi-finished product comprising:

a nickel-titanium alloy and an amount X of one or more additional elements, wherein:

nickel amount is comprised between 40 and 52 atom %, the amount X is comprised between 0.1 and 1 atom %, the balance being titanium;

the one or more additional elements are selected from Al, B, Ca, Ce, Hf, La, Mo, Nb, Re, Si, Ta, V, W, Y and Zr; and the amount X and the one or more additional elements are selected to result in variation of the amount X over different points of the semi-finished product being less than 20%.

2. The semi-finished product of claim 1, wherein:

the amount X is comprised between 0.1 and 0.5 atom %.

3. The semi-finished product of claim 2, wherein:

the amount X is comprised between 0.1 and 0.25 atom %.

4. The semi-finished product of claim 1, wherein:

the one or more additional elements are selected from Al, B, Ca, La, Re, Si, W, Y, and Zr; and the atom % for each of the one or more additional elements is comprised between 0.1 and 0.5 atom %.

5. The semi-finished product of claim 1, wherein:

the one or more additional elements are selected from Hf, Mo, Nb, Si, Ta, and V.

6. The semi-finished product of claim 1, said semi-finished product being a wire-shaped product.

7. The semi-finished product of claim 1, said semi-finished product being a tube-shaped product.

8. The semi-finished product of claim 1, said semi-finished product being a rod-shaped product.

9. The semi-finished product of claim 1, said semi-finished product being a metal sheet-shaped product.

10. A finished product obtained through the semi-finished product according to claim 1.

11. The finished product of claim 10, wherein the finished product is obtained by cutting the semi finished product.

12. A method of using the semi-finished product of claim 1 to determine the variation of the amount X over different points of the semi-finished product, comprising:

sampling points along a length of the semi-finished product at a set distance between points; and for each point, measuring the amount X.

13. A method of using a semi-finished product, the semi-finished product comprising:

a nickel-titanium alloy and an amount X of one or more additional elements, wherein:

nickel amount is comprised between 40 and 52 atom %, the amount X is comprised between 0.1 and 1 atom %, the balance being titanium;

the one or more additional elements are selected from Al, B, Ca, Ce, Hf, La, Mo, Nb, Re, Si, Ta, V, W, Y and Zr; and the amount X and the one or more additional elements are selected to result in variation of the amount X over different points of the semi-finished product being less than a set percentage, the method being for determining the variation of the amount X over different points of the semi-finished product, the method comprising:

sampling points along a length of the semi-finished product at a set distance between points; and for each point, measuring the amount X.

* * * * *